US008052273B2

(12) United States Patent
Suzuki

(10) Patent No.: US 8,052,273 B2
(45) Date of Patent: Nov. 8, 2011

(54) INK JET RECORDING APPARATUS

(75) Inventor: Kentaro Suzuki, Chiba (JP)

(73) Assignee: Seiko I Infotech Inc. (JP)

( * ) Notice: Subject to any disclaimer, the term of this patent is extended or adjusted under 35 U.S.C. 154(b) by 935 days.

(21) Appl. No.: 12/070,327

(22) Filed: Feb. 14, 2008

(65) Prior Publication Data

US 2008/0204536 A1 Aug. 28, 2008

(30) Foreign Application Priority Data

Feb. 19, 2007 (JP) ..... 2007-038276

(51) Int. Cl.
*B41J 2/01* (2006.01)

(52) U.S. Cl. ..... 347/102

(58) Field of Classification Search ..... 347/17, 347/102

See application file for complete search history.

(56) References Cited

U.S. PATENT DOCUMENTS

| | | | | |
|---|---|---|---|---|
| 6,543,890 | B1 * | 4/2003 | Ylitalo et al. | 347/102 |
| 6,834,948 | B2 * | 12/2004 | Asano et al. | 347/102 |
| 2007/0070162 | A1 * | 3/2007 | Yokoyama | 347/102 |
| 2009/0231404 | A1 * | 9/2009 | Niekawa | 347/102 |

FOREIGN PATENT DOCUMENTS

| | | | |
|---|---|---|---|
| EP | 1348565 | | 10/2003 |
| JP | 54151446 | A * | 11/1979 |
| JP | 2004322467 | | 11/2004 |
| JP | 2004338263 | | 12/2004 |
| JP | 2004338264 | | 12/2004 |
| JP | 2006068937 | | 3/2006 |
| JP | 2006116907 | | 5/2006 |
| JP | 2006264249 | | 10/2006 |
| WO | 2007043507 | | 4/2007 |

* cited by examiner

*Primary Examiner* — Daniel Petkovsek
(74) *Attorney, Agent, or Firm* — Adams & Wilks

(57) ABSTRACT

An ink jet recording apparatus has an ink jet head mounted for movement in a scanning direction to record on a surface of a recording medium using an active ray curing type ink. An active ray irradiation device is disposed adjacent to the ink jet head for irradiating an active ray to cure the ink on the surface of the recording medium. A plate is mounted to undergo movement in the scanning direction of the inkjet head for preventing an active ray from the active ray irradiation device and reflected by the platen from entering in ink discharge surface of the ink jet head. The plate is disposed adjacent to an end portion of the recording medium and in an arbitrary position between a surface lying substantially on the same plane as the surface of the recording medium and the ink discharge surface of the ink jet head. A plate position adjusting mechanism and a head position adjusting mechanism are provided for moving the plate and the ink jet head, respectively, in a direction orthogonal to the recording medium.

19 Claims, 5 Drawing Sheets

INK JET RECORDING APPARATUS

BACKGROUND OF THE INVENTION

1. Field of the Invention

The present invention relates to an ink jet recording apparatus which performs recording by using a recording liquid which is cured by irradiation with an active ray.

2. Related Background Art

In recent years, there is known an ink jet recording apparatus in which ultraviolet curable ink (hereinafter, referred to as UV ink) to be cured by an ultraviolet ray is used as ink ejected by an ink jet head, the UV ink is ejected and adhered to a recording medium such as a PVC sheet, glass, a foamed board, or a plate, and after that, an ultraviolet ray is applied to cure and fix the UV ink on the recording medium.

According to Japanese Patent Application Laid-open No. Sho 60-132767 and Japanese Patent Application Laid-open No. 2004-338264 and the like, there are proposed recording apparatuses of a type, in which an ink jet head moves in a direction orthogonal to a conveying direction of a recording medium (hereinafter, referred to as main scanning direction), that is, a so-called serial type, and which has an ultraviolet ray irradiation lamp provided to at least one of both side portions in the main scanning direction of the ink jet head and moving together with the head. Further, Japanese Patent Application Laid-open No. Sho 60-132767 also proposes an apparatus of a so-called line type, in which an ink jet head is stationary and has a length larger than a width of a recording medium in the main scanning direction and an ultraviolet ray irradiation lamp for irradiating an overall width of the recording medium is disposed on a recording medium delivery side of the head.

On the other hand, Japanese Patent Application Laid-open No. 2004-338264 discloses an invention for solving a problem in that, when an ultraviolet ray irradiation lamp moves to the outside of a region of a platen (home position or head moving direction changing position) for supporting a recording medium in an ink ejection forward side of an ink jet head, an ultraviolet ray applied from the ultraviolet ray irradiation lamp is reflected on a casing wall portion of the apparatus to enter a nozzle portion of the ink jet head, thereby causing the ink in the nozzle portion to be cured. As means for solving the problem, a plate material for preventing the reflection of the ultraviolet ray is set, in the home position or the head moving direction changing position, to substantially the same height as the platen.

However, the invention disclosed in Japanese Patent Application Laid-open No. 2004-338264 is perhaps effective in a case where printing is performed on thin recording media such as roll paper, but in a case where the recording medium is thicker, a step height between a recording surface of the recording medium and the platen for supporting the recording medium cannot be ignored for solving the above-mentioned problem. That is, in flatbed printers, hybrid printers, or the like, in a case where printing is performed on a rigid medium having a plate thickness, such as aplastic board or a glass plate, when an ultraviolet ray irradiation device is situated above the rigid medium, an ultraviolet ray does not enter the nozzle portion, but at a moment when the ultraviolet ray irradiation device retained at a constant height with respect to a recording surface of the rigid medium moves to the outside of an end side in a width direction of the rigid medium, the height thereof becomes larger. That is, an irradiation direction space of the ultraviolet ray irradiation device increases. As a result, due to reflection, scatter, diffraction, or the like of the ultraviolet ray from the ultraviolet ray irradiation device to the ink jet head side, leak light increases, thereby causing the ink curing in the nozzle portion.

An occurrence state of this problem is described in detail with reference to FIGS. 4A-4C. FIGS. 4A, 4B and 4C are each a schematic view of a recording apparatus viewed from a conveying direction of a rigid medium 1, and illustrate a step in which an ink jet head 2 performs printing with UV ink while moving in a main scanning direction, and an ultraviolet ray irradiation device 3 allows the UV ink to be cured. In a stage shown in FIG. 4A, a height of the ink jet head 2 and the ultraviolet ray irradiation device 3 with respect to a printing surface of the rigid medium 1 on a platen 4 is set to a position where an ultraviolet ray from the ultraviolet ray irradiation device 3 does not enter a nozzle portion of the ink jet head 2, the ultraviolet ray irradiation device 3 being provided on an opposite side of the head moving direction thereof. Further, by a light shielding plate 5 provided between the ultraviolet ray irradiation device 3 and the ink jet head 2 adjacent thereto, the ultraviolet ray to the nozzle portion is shielded. However, in a stage shown in FIG. 4C, the ultraviolet ray irradiation device 3 is positioned outside the rigid medium 1, so the irradiation direction space of the ultraviolet ray irradiation device 3 increases by a thickness of the rigid medium 1. As a result, an ultraviolet ray 6 from the ultraviolet ray irradiation device 3 reflects, scatters, etc. on the platen 4 or a member therearound, or diffracted light diffracted around the light shielding plate 5 enters the nozzle portion of the ink jet head 2.

The problem described above can be solved by providing the ultraviolet ray irradiation device with a shutter mechanism capable of shielding the ultraviolet ray. However, in order to achieve this, at a timing immediately before the ultraviolet ray irradiation device 3 positioned on a back side of the ink jet head 2 moving in the main scanning direction reaches the end side in the width direction of the rigid medium (stage shown in FIG. 4B), the shutter of the ultraviolet ray irradiation device has to be closed. As a result, there is a problem in that the UV ink printed in the vicinity of the end side in the width direction of the rigid medium 1 cannot be cured, so the printing with respect to the corresponding portion (no-margin printing) cannot be performed.

SUMMARY OF THE INVENTION

In view of the above-mentioned related-art problem, it is therefore an object of the present invention to prevent, in an ink jet recording apparatus for performing printing with active ray curing type ink, ink curing in the nozzle portion at a time of printing on a thick rigid medium on the platen and to enable the no-margin printing on the rigid medium.

An ink jet recording apparatus according to the present invention includes: an ink jet head for performing recording by discharging droplets of active ray curing type ink onto a recording medium; and an active ray irradiation device disposed adjacently to the ink jet head, for curing the active ray curing type ink discharged onto a recording surface of the recording medium.

Further, there is provided a plate which can be disposed in a vicinity of an end portion of the recording medium and is movable, whereby the above-mentioned problem is solved.

That is, in the present invention, when the active ray irradiation device is positioned outside a recording region of the thick recording medium called rigid medium while remaining in an active ray irradiation state, here, a plate which can be disposed in an arbitrary position between a surface substantially flush with the recording surface and the ink discharge surface of the ink jet head exists, so the irradiation direction space of the active ray irradiation device is not enlarged. Accordingly, the active ray from the active ray irradiation device does not enter the nozzle portion of the ink jet head, thereby preventing the curing of the ink in the nozzle portion. Further, owing to this, no-margin printing on the thick recording medium, which cannot be performed in the related art is enabled.

In the ink jet recording apparatus, there is preferably provided a plate position adjusting mechanism for making the plate movable in a thickness direction of the recording medium so that a surface on a side of the ink jet head and on a side of the active ray irradiation device of the plate vertically moves in parallel with respect to the recording surface.

Further, there is preferably provided a head position adjusting mechanism for making the ink jet head movable in a thickness direction of the recording medium so that a distance from the recording surface to an ink discharge surface of the ink jet head can be changed.

In this case, it is preferable that, when the head position adjusting mechanism adjusts a position of the ink jet head, the plate position adjusting mechanism move the plate in association therewith. With this structure, by adjusting the position of the ink discharge surface of the ink jet head correspondingly to the thickness of the recording medium to be conveyed, the surface on the ink jet head side and the active ray irradiation device side of the plate is automatically adjusted to a predetermined position between the surface substantially flush with the recording surface and the ink discharge surface of the ink jet head.

In order to achieve this, it is necessary that a distance from the recording surface to the surface on the side of the ink jet head and on the side of the active ray irradiation device of the plate and the distance from the recording surface to the ink discharge surface of the ink jet head be each adjusted to a given distance in advance.

Further, in the above-mentioned ink jet recording apparatus, there is desirably provided a slide mechanism for enabling the plate to slide so as to be in contact with an end of the recording medium in accordance with an outer configuration of the recording medium. As a result, even when an outer configuration of the recording medium to be conveyed is changed, a flat surface adjacent to the recording surface of the recording medium can be structured.

The slide mechanism includes a rail member disposed in a direction orthogonal to a conveying direction of the recording medium so as to guide the plate in a freely slidable manner.

In a case of an ink jet recording apparatus of a serial type, it is conceived that the rail member is disposed along a rail for guiding the ink jet head in the direction crossing the conveying direction of the recording medium.

Further, it is preferable that a surface on a side of the ink jet head and on a side of the active ray irradiation device of the plate be subjected to treatment for preventing reflection, scatter, or the like of an active ray.

Further, it is preferable that the plate be disposed on at least one of both sides in a direction crossing a conveying direction of the recording medium.

The above-mentioned plate disposed on one of both sides in the direction crossing the conveying direction of the recording medium may have the following structure. That is, in an ink jet recording apparatus of a serial type, in a home position of the ink jet head, a maintenance mechanism for maintaining and recovering discharge of the head is provided in some cases. The recording apparatus of the present invention uses active ray curing type ink. Accordingly, the maintenance mechanism includes a shutter mechanism for preventing incidence of the active ray and a plate-like member provided therearound. In this case, by making the shutter mechanism and the plate-like member movable in a thickness direction of the recording medium, the same function as that of the plate can be achieved.

Further, in the ink jet recording apparatus as described above, between the ink jet head and the active ray irradiation device, a light shielding plate is desirably provided, for shielding the active ray from the active ray irradiation device to the ink discharge surface of the ink jet head. In this case, there is desirably provided a light shielding plate position adjusting mechanism, by which, even when positions of the ink jet head and the active ray irradiating device are adjusted with respect to the recording surface, a gap between the plate and the light shielding plate are maintained constant.

Further, there is preferably provided friction reducing means between an end portion of the plate and the recording medium, the friction reducing means being provided to the end portion on a side of the recording medium of the plate and being brought into contact with the recording medium.

Further, there is preferably provided an ink removing layer provided on a part or an entire surface which is brought into contact with the recording medium of the plate, for facilitating removal of the active ray curing type ink in a case where the active ray curing type ink is adhered thereto.

Note that the term "active ray" in the scope of claims and in this specification, includes ones having property of diffraction, reflection, or the like, such as light, an electron ray, and a radiation ray. Further, as the active ray used for curing the active ray curing type ink, an ultraviolet ray, a near-infrared ray, an electron ray, or the like are preferable.

According to the present invention described above, when the ink jet recording is performed on the thick rigid medium with the active ray curing type ink, ink curing in the nozzle portion by the active ray can be prevented and the no-margin printing on the rigid medium is enabled.

DETAILED DESCRIPTION OF THE PREFERRED EMBODIMENTS

Figure 4A:
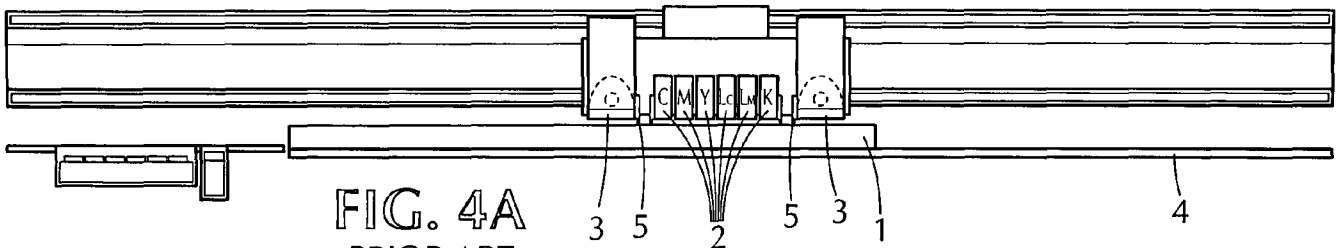
FIG. 4A PRIOR ART
FIGS. 4A, 4B and 4C are views for illustrating a problem to be solved by the present invention.
Figure 4B:
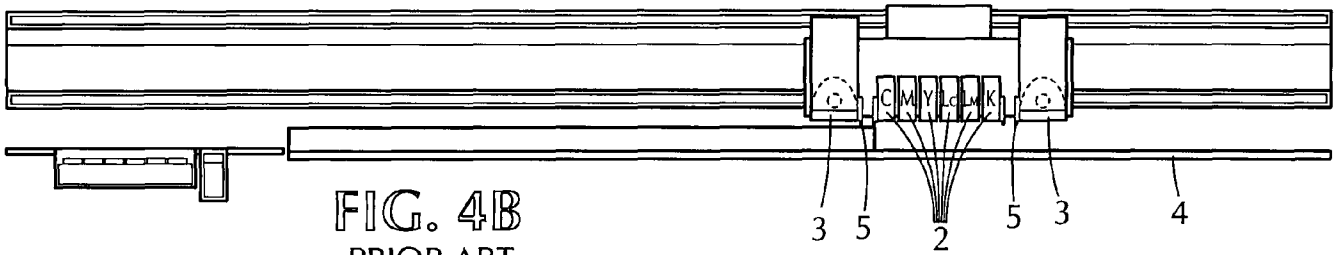
FIG. 4B PRIOR ART
Figure 4C:
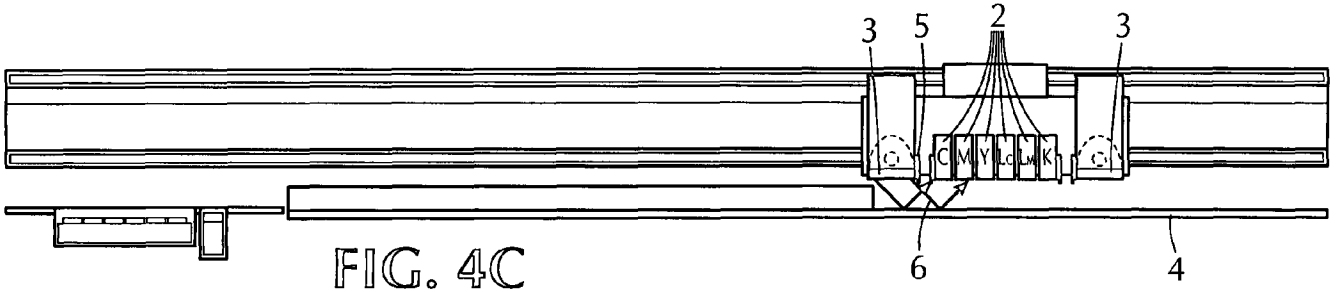
FIG. 4C PRIOR ART

Hereinafter, description will be made of an embodiment of the present invention with reference to the drawings. Note that, herein, the same components as those of the related-art apparatus structure illustrated in FIGS. 4A to 4C are denoted by the same reference numerals.

Figure 1:
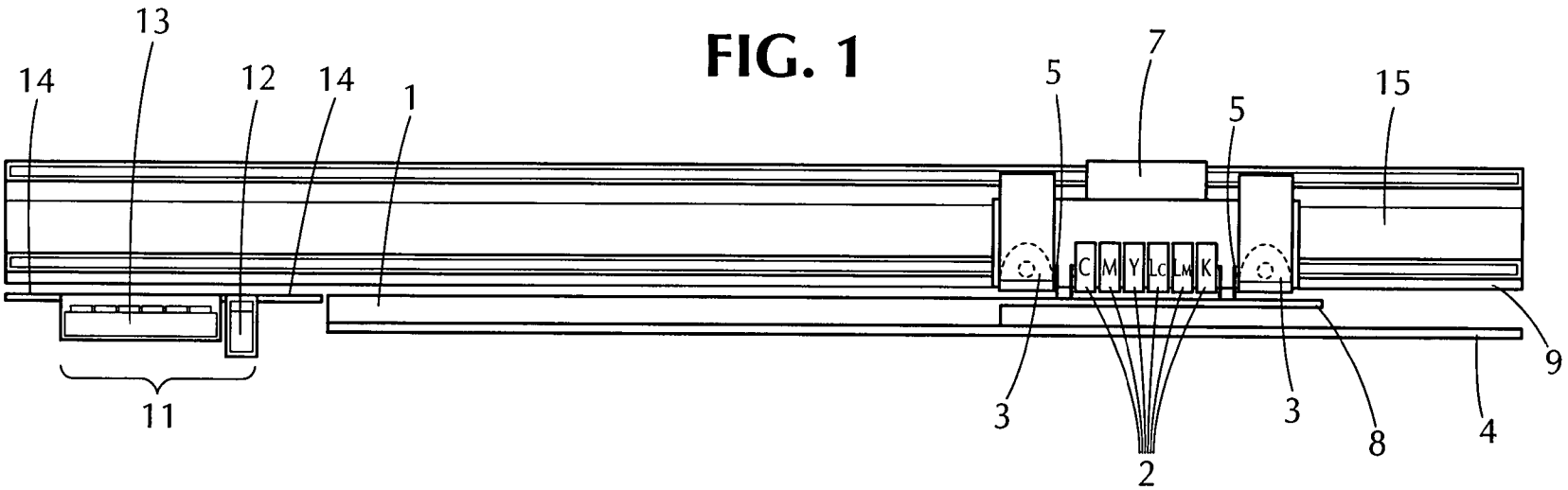
FIG. 1 is a schematic view of an ink jet recording apparatus according to an embodiment of the present invention, viewed from a conveying direction of a recording medium (rigid medium)
Figure 2A:
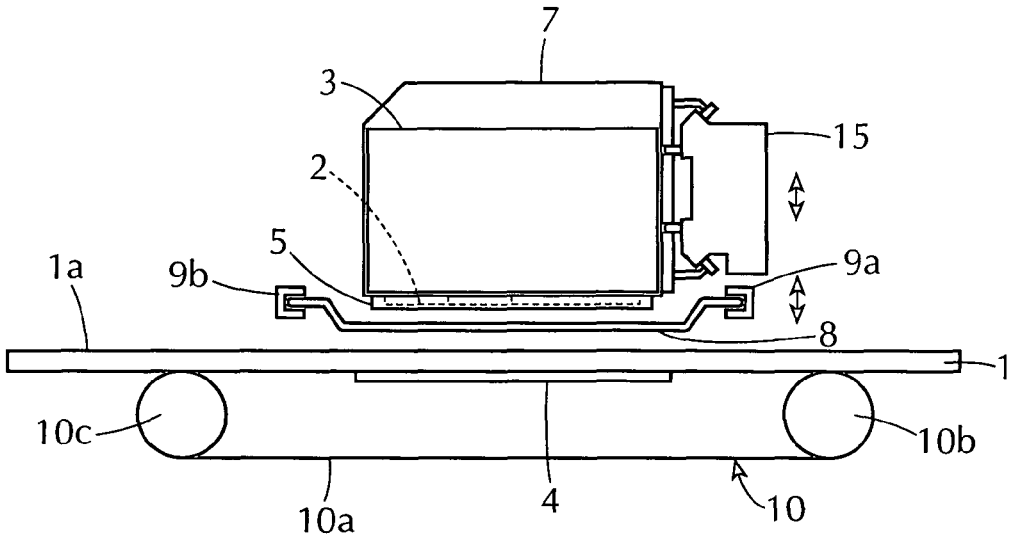
FIGS. 2A and 2B are schematic views of the ink jet recording apparatus according to the embodiment of the present invention viewed from a main scanning direction, the view illustrating an installation state of an anti-reflection plate.
Figure 2B:
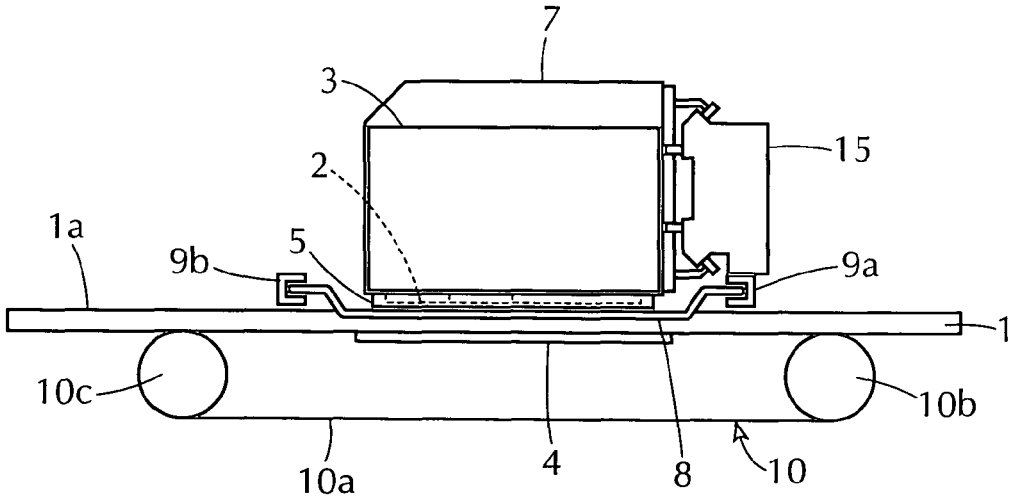

FIG. 1 is a schematic view of an ink jet recording apparatus according to an embodiment of the present invention, the recording apparatus being viewed from a conveying direction of a rigid medium. FIGS. 2A and 2B are schematic views of the recording apparatus viewed from a main scanning direction.

In those figures, the ink jet recording apparatus according to this embodiment includes an ink jet head 2 for discharging UV ink of six colors (cyan C, magenta M, yellow Y, light cyan Lc, light magenta Lm, black K), ultraviolet ray irradiation devices 3 for irradiating an ultraviolet ray for curing the UV ink, and a carriage 7 for mounting those. The carriage 7 engages with a carriage rail 15 extending in the main scanning direction and can reciprocatingly move along the carriage rail 15 by drive means including a motor and an endless belt. Further, the ultraviolet ray irradiation devices 3 on the carriage 7 are disposed on both sides in the main scanning direction of the ink jet head 2 for six colors. In the recording apparatus, each of an ink discharge surface of the ink jet head 2 and ultraviolet ray irradiation holes of the ultraviolet ray irradiation devices 3 is oriented in a substantially gravitational direction. Between the ultraviolet ray irradiation device 3 and the ink jet head 2 adjacent thereto, a plurality of shielding plates 5 are provided, thereby reducing leakage of the ultraviolet ray from the ultraviolet ray irradiation device 3, reflected, scattered, etc. on the rigid medium 1 to the ink jet head 2 side.

The rigid medium 1 onto which the UV ink is discharged from the ink jet head 2 is supported by an upper surface of the platen 4 such that the recording surface thereof is maintained flat, and the rigid medium 1 is conveyed and supported by a conveying means 10. The platen 4 has a sufficient width in the main scanning direction, for supporting the rigid medium 1 of a maximum size on which the printing can be performed by this recording apparatus. On the other hand, various conveying mechanisms using a roller, a belt, or the like can be applied to the conveying means 10. As an example thereof, there is conceived a structure in which, as shown in FIG. 2A or 2B, a belt-like member 10*a* is looped around at least two pulleys 10*b* and 10*c*, a part of the belt-like member 10*a* is exposed on an upper surface of the platen 4 or is exposed between divided platens, and the belt-like member 10*a* is provided with suction means for sucking the rigid medium 1 or adhesion means for adhering the rigid medium 1 (not shown). Note that the recording apparatus according to the present invention may be a compatible device in which the conveying means 10 for the rigid medium 1 can be replaced with one conveying thin recording medium such as roll paper by a roll-to-roll mechanism.

Further, in the present invention, a plate 8 forming a flat surface is provided to an outside of a region of the rigid medium 1 to be conveyed. The plate 8 can be disposed at any height position between substantially the same height as a recording surface 1*a* of the rigid medium 1 and the ink discharge surface of the ink jet head 2, and can be disposed so as to be adjacent to an end surface of the rigid medium 1.

In order to achieve this, the plate 8 is slidably suspended on two rail members 9*a* and 9*b* arranged in substantially parallel to each other in the main scanning direction. One rail member 9*a* of the two rail members 9 is disposed below the carriage rail 15 and along the carriage rail 15. The other rail member 9*b* is disposed at an interval from the rail member 9*a* in the conveying direction of the rigid medium, the interval being larger than an outside dimension of the carriage 7, the ink jet head 2, and the like. The rail members 9*a* and 9*b* are arranged at a position sufficiently higher than a flat surface portion of the plate 8 when the plate 8 is installed at substantially the same height as the recording surface 1*a* of the rigid medium 1. Accordingly, both ends of the flat surface portion of the plate 8 are folded to be engaged with the rail members 9*a* and 9*b*. With the above-mentioned structure, the rail members 9*a* and 9*b* do not interfere with conveyance of the rigid medium 1, and the plate 8 is enabled to slide in the main scanning direction to be positioned in the end surface position of the rigid medium 1 of various size widths. Note that a slide operation of the plate 9 may be performed by using drive means such as a linear actuator or a ball screw. Further, in a case of a compatible device in which recording with the rigid medium can be changed to recording with a roll medium, in order to ensure a space for easily replacing the conveying means 10 including the platen 4, it is preferable that the rail members 9*a* and 9*b* be extended to be longer than the carriage rail 15 and a retraction area for the plate 8 be provided.

Further, as shown in FIGS. 2A and 2B, in order to enable vertical parallel movement of a height of the upper surface of the plate 8 with respect to the recording surface 1*a* of the rigid medium 1, the rail member 9*a* and the rail member 9*b* can be moved and adjusted in a direction orthogonal to the recording surface 1*a* of the rigid medium 1 (vertical direction of the figure) at the same time. Further, even when the thickness of the rigid medium 1 to be conveyed is changed, a height (distance) from the recording surface 1*a* of the rigid medium 1 to the ink discharge surface of the ink jet head 2 on the carriage 7 has to be continuously a given distance X, so the carriage rail 15 as a whole can also be moved and adjusted in the vertical direction of the figure. For example, the carriage rail 15 and the rail members 9*a* and 9*b* are attached to a nut portion of a ball screw (not shown) disposed in the vertical direction of the figure as a column, and can be vertically moved by rotating a screw shaft of the ball screw by a motor or the like. Alternatively, in place of the ball screw, both ends of the carriage 15 and the rail members 9*a* and 9*b* may be attached to a linear actuator. As a matter of course, a height adjusting mechanism used in the present invention is not limited thereto.

The rail members 9*a* and 9*b* for suspending the plate 8 can be vertically moved individually. However, vertical movement mechanisms of the rail members 9*a* and 9*b* are also associated with a vertical movement mechanism of the carriage rail 15. Specifically, when, in accordance with the thickness of the rigid medium 1 to be conveyed, a distance from the recording surface 1*a* of the rigid medium 1 to the ink discharge surface of the ink jet head 2 is made variable by the vertical movement mechanism of the carriage rail 15, the rail members 9*a* and 9*b* and the plate 8 suspended on the rail members 9*a* and 9*b* move in association therewith, thereby changing the height position of the upper surface of the plate 8.

At this time, it is preferable that the vertical movement mechanisms of the carriage rail 15 and the rail members 9*a* and 9*b* be used to set the distance from the recording surface 1*a* of the rigid medium 1 to the ink discharge surface of the ink jet head 2 to the above-mentioned given distance X, and at the same time, a distance from the recording surface 1*a* thereof to the upper surface of the plate 8 be set to a predetermined distance in advance. A reason for this is because, when, since the height of the recording surface 1*a* of the rigid medium 1 changes, the distance from the recording surface 1*a* of the rigid medium 1 to the ink discharge surface of the ink jet head 2 is set again to the above-mentioned distance X by the vertical movement mechanism of the carriage rail 15, the height (distance) of the upper surface of the plate 8 with respect to the recording surface 1*a* automatically becomes the predetermined distance which is set in advance. That is, the height adjustments of the ink jet head 2 and the plate 8 are associated with each other, so, even when the height of the ink discharge surface of the ink jet head 2 is changed in accordance with the height position of the recording surface 1*a* of the rigid medium 1, the distance between the recording surface and the upper surface of the plate 8 is continuously retained to be the predetermined distance.

With the above-mentioned structure, when the plate 8 whose height is adjusted to a predetermined height position between the recording surface 1*a* of the rigid medium 1 and the ink discharge surface of the ink jet head 2 is slid according to the width of the rigid medium 1 to be made adjacent to the end surface of the rigid medium 1, the step height corresponding to the thickness of the rigid medium 1 is reduced. After the setting as described above, the carriage 7 is moved from a left end to a right end of FIG. 1, and at the same time, the ink jet head 2 performs recording by the UV ink on the rigid medium 1, and the UV ink is cured by the ultraviolet ray irradiation device 3 on a back side of a head advancing direction. In this printing operation, printing is performed on the rigid medium 1 including the end sides in the width direction thereof, that is, the no-margin printing is performed. Thus, UV irradiation cannot be interrupted by a shutter or the like until the ultraviolet ray irradiation device 3 on the back side of the head advancing direction passes above the rigid medium 1 and comes to a position as shown in FIG. 1 (that is, outside the region of the rigid medium). In the present invention, even when the ultraviolet ray irradiation device 3 is moved to the above-mentioned place while being kept in a UV irradiation state, the plate 8 exists in this place, so the irradiation direction space of the ultraviolet ray irradiation device 3 is not enlarged. As a result, the ultraviolet ray from the ultraviolet ray irradiation device 3 is shielded by the light shielding plate 5 and does not reach the nozzle portion of the ink jet head 2. Accordingly, even when no-margin UV printing for a thick recording medium is performed, curing of the ink in the nozzle portion can be prevented. In other words, the no-margin UV printing for the thick recording medium which cannot be performed in the related art can be performed.

Further, with the recording apparatus according to this embodiment, regardless of the thickness of the recording medium, the height of the ink discharge surface of the ink jet head 2 and the height of the plate 8 can be made variable independently of each another. Thus, the height of the plate 8 can be made as close as possible to the height of the ink discharge surface of the ink jet head 2. When the plate 8 is made closer to the ink discharge surface of the ink jet head 2, leakage of the ultraviolet ray from the ultraviolet ray irradiation device 3 to the ink jet head 2 is reduced by a corresponding amount. That is, the irradiation direction space of the ultraviolet ray irradiation device 3 is made narrower, so the ultraviolet ray reaching the head is reduced by a corresponding amount, thereby making it possible to prevent curing of the ink in the nozzle portion.

Note that the ultraviolet ray from the ultraviolet ray irradiation device 3 is applied onto the plate 8 to be reflected, scattered, etc., so the surface of the plate 8 is subjected to anti-reflection treatment with an ultraviolet ray absorber or the like or black light absorbing treatment such as black alumite treatment.

Figure 5:
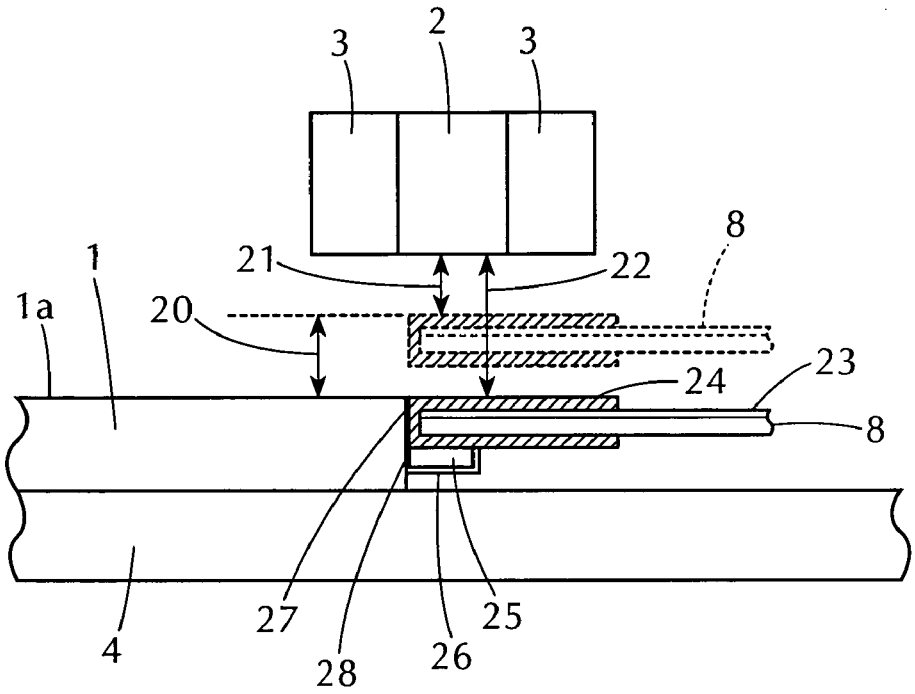
FIG. 5 is an explanatory view of an anti-reflection plate according to another embodiment of the present invention.

FIG. 5 is a view showing another mode of the plate 8 subjected to the above-mentioned treatment, and is a schematic view of the apparatus viewed from the conveying direction of the recording medium.

In this figure, the surface on the ink jet head 2 side of the plate 8 is subjected to an anti-reflection layer 23. The anti-reflection layer 23 is subjected to the anti-reflection treatment with the ultraviolet ray absorber or the like, or the black light absorbing treatment such as the black alumite treatment. Thus, reflectance of the ultraviolet ray in a case where the anti-reflection layer 23 exists is made smaller than in a case where the anti-reflection layer does not exist, thereby reducing reflection of the ultraviolet ray. Further, on the surface of the plate 8 including the anti-reflection layer 23, there is provided an ink removing layer 24. The ink removing layer 24 is made of a fluororesin which is a liquid-resistant material, and a surface of the ink removing layer 24 is a layer having smaller irregularities than those of the anti-reflection layer 23 or the surface of the plate 8, thereby increasing smoothness. Accordingly, in a case where ink is adhered and fixed, the ink can be more easily removed when the ink removing layer 24 is provided. Further, the ink removing layer 24 also serves to facilitate removal of the ink adhered due to misting or splash of the ink. Accordingly, while in FIG. 5 the ink removing layer 24 is disposed in a part so as to cover an end portion on the rigid medium 1 side, this is for protecting, at a minimum degree, a part on which the ink easily splashes. The ink removing layer 24 may be provided so as to cover the anti-reflection layer 23 or to cover an overall portion. Further, as another mode, by adding an ultraviolet ray anti-reflection agent to the ink removing layer 24, the ink removing layer can be provided without losing ultraviolet ray anti-reflection.

Further, a roller 25 is disposed on the end portion on the rigid medium 1 side of the plate 8. The roller 25 is brought into contact with a side surface of the rigid medium 1 at a contact surface 28. Further, the roller 25 is arranged so as to slightly protrude from a side surface of the plate 8, whereby an opposed surface 27 of the plate 8 with respect to the rigid medium 1 is not brought into contact therewith and a space exists therebetween. The roller 25 abuts on the side surface of the rigid medium 1, thereby reducing resistance due to contact. As a result, the rigid medium 1 can be smoothly conveyed. If there is not the roller 25, the rigid medium 1 is rubbed against the plate 8 while being conveyed. Accordingly, there is such a risk that the rigid medium 1 cannot be normally conveyed by an amount desired to be conveyed.

Similarly to the plate 8, on a surface of the roller 25, an ink removing layer 26 is provided, thereby making it possible to easily remove ink when the ink is adhered and fixed thereto. Further, although not shown, it is preferable that, on a lower layer of the ink removing layer 26, an anti-reflection layer like that of the plate 8 be provided. The roller 25 is friction reducing means for reducing friction due to contact between the plate 8 and the rigid medium 1. Other than the roller 25, a circular arc guide for reducing a contact area between the plate 8 and the rigid medium 1 may be used.

The plate 8 can be vertically moved by the vertical movement mechanisms of the rail members 9*a* and 9*b*. A first distance 22 is a distance between the upper surface of the plate 8 and the ink discharge surface of the ink jet head 2 in the case where the upper surface of the plate 8 exists at substantially the same height as the recording surface 1*a* of the rigid medium 1. A second distance 21 is a distance between the upper surface of the plate 8 and the ink discharge surface of the ink jet head 2 in the case where the plate 8 exists in a position closer to the ink jet head 2 than to the recording surface 1*a* of the rigid medium 1. A third distance 20 is a distance from the recording surface 1*a* of the rigid medium 1 to a surface on the ink jet head 2 side of the plate 8. The smaller the first distance 21 is, the less the ultraviolet ray applied to the ink jet head 2 becomes. A preferable case is that the third distance 20 is a positive value, that is, the surface on the ink jet head 2 side of the plate 8 is closer to the ink jet head 2 than to the recording surface 1*a* of the rigid medium 1. In this case, the irradiation direction space from the upper side of the rigid medium 1 to the ultraviolet ray irradiation device 3 becomes narrower, so the ultraviolet ray reaching the head is reduced by the corresponding amount, thereby making it possible to prevent curing of the ink in the nozzle portion. On the other hand, in a case where the first distance 22 becomes larger, and the surface on the ink jet head 2 side of the plate 8 is farther from the ink jet head 2 than the recording surface 1*a* of the rigid medium 1, the irradiation direction space from the upper side of the rigid medium 1 to the ultraviolet ray irradiation device 3 becomes wider, so the ultraviolet ray reaching the head increases by the corresponding amount. However, when compared to the case where the plate 8 does not exist, the irradiation of the head with the ultraviolet ray is reduced, thereby making it possible to obtain an effect of preventing curing of the ink in the nozzle portion.

Further, in the ink jet recording apparatus, the carriage 7 is allowed to reciprocatingly scan on the recording medium 1 to perform high-speed printing in some cases. In this case, it is desirable that, not only the plate 8 can be provided to one side in the main scanning direction of the rigid medium 1 as shown in FIG. 1, but also a plate having the same mechanism be provided to an opposite side (home position side of ink jet head 2) of the plate 8 with respect to the rigid medium 1. However, in the home position of the ink jet head 2, a maintenance device 11 for maintaining and recovering normal discharge of the ink jet head 2 is generally provided.

As shown in FIG. 1, the maintenance device 11 has a wiper 12 which is allowed to abut on the ink discharge surface of the moving ink jet head 2 to wipe off ink adhered to the ink discharge surface, a suction mechanism 13 which sucks the nozzle portion of the ink jet head 2 to perform ink charging, ink refreshing, or the like. Further, there is also provided a later-described shutter mechanism which covers the wiper 12, the suction mechanism 13, and the like with a plate, for preventing curing of the UV ink adhered thereto. In this case, the shutter mechanism and a plate-like member 14 overhanging therearound are combined with each other to form a flat plate, thereby making it possible to vertically move the maintenance device 11. As a result, the same function as that of the plate 8 which can be freely adjusted in height can be provided to the home position side of the ink jet head 2. Further, this construction enables to avoid unnecessary increase in size of the apparatus.

Figure 6:
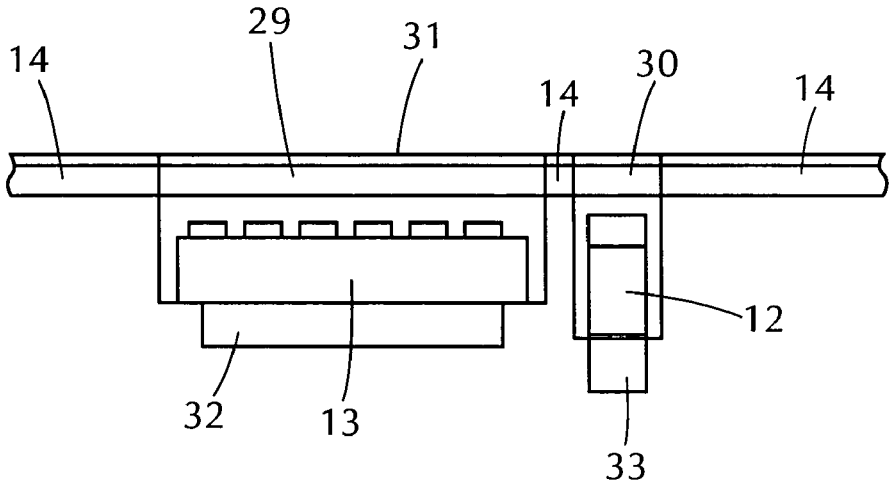
FIG. 6 is an explanatory view of a maintenance device according to the embodiment of the present invention.

FIG. 6 is an enlarged view of the maintenance device 11 described above. Above the suction mechanism 13, a suction portion shutter 29 is provided so as to be substantially flush with the plate-like member 14. The suction portion shutter 29 is closed when the suction mechanism 13 is not in use, thereby making the irradiation direction space of the ultraviolet ray irradiation device 3 narrow. Similarly, also above the wiper 12, a wiper shutter 30 is provided, which is closed when the wiper 12 is not in use, thereby making the irradiation direction space of the ultraviolet ray irradiation device 3 narrow. Further, on surfaces on the ultraviolet ray irradiation device 3 side of the plate-like member 14, the suction portion shutter 29, and the wiper shutter 30, as a maintenance portion surface layer 31, an anti-reflection layer and an ink removing layer like those of the plate 8 shown in FIG. 5 are provided, thereby preventing reflection of the ultraviolet ray and facilitating removal of the ink. Further, it is preferable that there be provided a movement adjustment mechanism enabling vertically moving a flat plate formed of the plate-like member 14, the suction portion shutter 29, and the wiper shutter 30 because the same effect as that of the plate 8 is obtained. Further, a suction device moving mechanism 32 is a mechanism for moving the suction mechanism 13 vertically with respect to the ink jet head 2, and linearly moves the suction mechanism 13 by a force of a motor. A wiper moving mechanism 33 is a moving mechanism for moving the wiper 12 vertically with respect to the ink jet head 2, and vertically moves the wiper 12 by the force of the motor.

Further, in the embodiment of the present invention, the rigid medium 1 is used as the recording medium, also in a case where the recording medium is not limited to the rigid medium and another recording medium is used as another mode, the effect of the present invention is exerted when a space in an irradiation direction of an active ray irradiation device is made narrower. The larger the distance from the platen 4 to the recording surface of the recording medium is, the larger an irradiation direction space for an active ray applied from an irradiation device. Accordingly, for example, the present invention can be used in a case where the rigid medium or a resin sheet is used and for a printer having a structure in which a width of the recording medium and a width of the platen are the same and a space exists outside and below the recording medium, or the like.

Figure 3A:
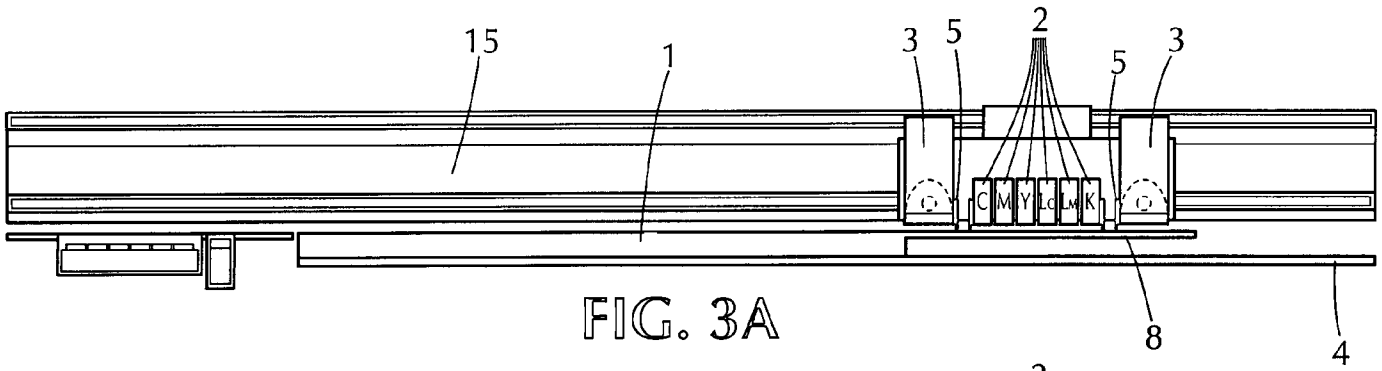
FIGS. 3A, 3B and 3C are views for illustrating height adjustment of a light shielding plate in the ink jet recording apparatus according to the embodiment of the present invention.
Figure 3B:
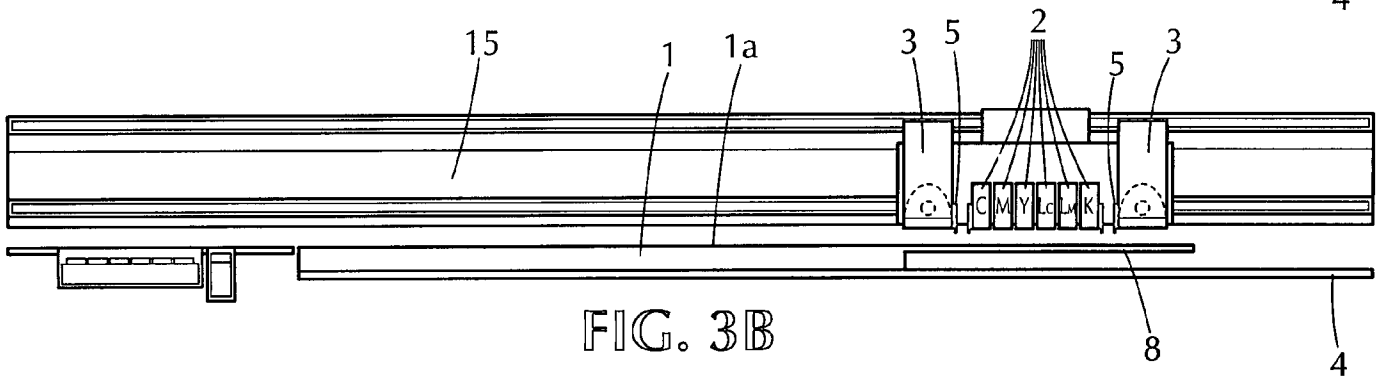
Figure 3C:
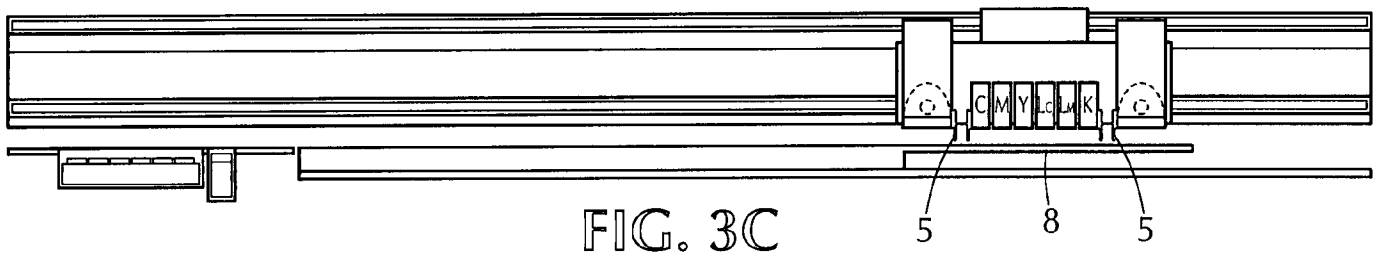

Further, of the recording medium, there are ones having warpage or irregular shapes, so, in a case where printing is performed of the medium of those kinds, there is a need for a larger head-medium distance than that at the time of normal printing. In this case, when the heights of the ink jet head 2 and the ultraviolet ray irradiation device 3 are adjusted by raising the carriage rail 15 in the normal printing state of FIG. 3A, the height of the light shielding plates 5 becomes higher in association therewith as shown in FIG. 3B. As a result, a gap between the plate 8 (rigid medium 1) and the light shielding plates 5 is enlarged, thereby causing UV light leakage on the plate 8 to the ink jet head 2 side to increase. Accordingly, even when the height adjustment of the ink jet head 2 and the ultraviolet ray irradiation device 3 are performed, there is a need of a mechanism by which the gap between the plate 8 and the light shielding plates 5 is maintained to be constant so as not to be enlarged as shown in FIG. 3C. Thus, it is desirable that each of the light shielding plates 5 be individually provided with a height adjusting mechanism for continuously maintaining the height of the light shielding plate with respect to the plate 8.

In the above embodiment, the ink jet recording apparatus of a so-called serial type is illustrated. However, the present invention is not limited to the ink jet recording apparatus of the serial type, and the plate 8 according to the present invention, and a slide mechanism and height adjusting mechanism thereof can be applied to a recording apparatus of a line type regarding. That is, in the recording apparatus of a line type, in order to enable the no-margin printing, an ink jet head unit having a length equal to or larger than a maximum width of the recording medium to be conveyed is fixed in the main scanning direction, and on a medium delivery side with respect to the head unit, an ultraviolet ray irradiation lamp for irradiating a region having a width equal to or larger than the maximum width of the recording medium to be conveyed is disposed. Accordingly, in a case where the recording medium to be conveyed is the thick rigid medium, the space below the ultraviolet ray irradiation lamp positioned outside the region of the rigid medium becomes wider by at least the thickness of the rigid medium than the UV irradiation space on the rigid medium. As a result, there is such a risk that the UV light from the ultraviolet ray irradiation lamp positioned outside the region of the rigid medium enters the nozzle portion of the ink jet head adjacent thereto. Thus, the plate 8 according to the present invention, and the slide mechanism and height adjusting mechanism are effective for the ink jet recording apparatus of the line type.

Note, a recording liquid such as ink discharged by the ink jet head of the present invention is not limited to the UV ink and may be recording liquid having possibility of being cured by being irradiated with an active ray such as a near-infrared ray and an electron ray.

What is claimed is:

1. An ink jet recording apparatus, comprising: an ink jet head having a nozzle portion and mounted to undergo movement in a scanning direction for performing recording by discharging droplets of an active ray curing type ink from an ink discharge surface of the nozzle portion onto a recording surface of a recording medium; an active ray irradiation device disposed adjacently to the ink jet head for irradiating an active ray to cure the active ray curing type ink discharged onto the recording surface of the recording medium; a platen for supporting the recording medium; a plate mounted to undergo movement in the scanning direction of the inkjet head for preventing an active ray irradiated from the active ray irradiation device and reflected by the platen from entering the nozzle portion of the ink jet head, the plate being disposed adjacent to an end portion of the recording medium and in an arbitrary position between a surface lying substantially on the same plane as the recording surface of the recording medium and the ink discharge surface of the nozzle portion of the ink jet head; a plate position adjusting mechanism for moving the plate in a direction orthogonal to the recording medium so that a surface of the plate on a side of the ink jet head and on a side of the active ray irradiation device is moved vertically in parallel with respect to the recording surface of the recording medium; and a head position adjusting mechanism for moving the ink jet head in a direction orthogonal to the recording medium so that a distance from the recording surface of the recording medium to the ink discharge surface of the nozzle portion of the ink jet head is made variable.

2. An ink jet recording apparatus according to claim 1; wherein the head position adjusting mechanism and the plate position adjusting mechanism are configured so that when a position of the ink jet head is moved by the head position adjusting mechanism, the plate position adjusting mechanism moves the plate in association therewith.

3. An ink jet recording, apparatus according to claim 2; further comprising an anti-reflection material disposed on a surface on a side of the ink jet head and on a side of the active ray irradiation device of the plate for preventing reflection of an active ray irradiated from the active ray irradiation device.

4. An ink jet recording apparatus according to claim 1; further comprising a slide mechanism for sliding the plate so as to be in contact with an end of the recording medium.

5. An ink jet recording apparatus according to claim 4; wherein the slide mechanism comprises a rail member extending in a direction crossing a conveying direction of the recording medium.

6. An ink jet recording apparatus according to claim 5; wherein the ink jet recording apparatus comprises a serial-type ink let recording apparatus; and wherein the rail member is disposed along a rail for guiding the ink jet head in the direction crossing the conveying direction of the recording medium.

7. An ink jet recording apparatus according to claim 4; wherein the plate is parallel to the recording surface of the recording medium.

8. An ink jet recording apparatus according to claim 4; further comprising an anti-reflection material disposed on a surface on a side of the ink jet head and on a side of the active ray irradiation device of the plate for preventing reflection of an active ray irradiated from the active ray irradiation device.

9. An ink jet recording apparatus according to claim 1; further comprising an anti-reflection material disposed on a surface on a side of the ink jet head and on a side of the active ray irradiation device of the plate for preventing reflection of an active ray irradiated from the active ray irradiation device.

10. An ink jet recording apparatus according to claim 1; wherein the plate is disposed on at least one of both sides of the recording medium in a direction crossing a conveying direction of the recording medium.

11. An ink jet recording apparatus according to claim 1; wherein the ink jet recording apparatus comprises a serial-type ink let recording apparatus; and further comprising a maintenance mechanism provided at a home position of the ink jet head for maintaining and recovering discharge of the ink jet head, the maintenance mechanism having a shutter mechanism for preventing entry of active rays and a plate-shaped member provided therearound; wherein the plate is disposed on one of both sides of the recording medium in a direction crossing a conveying direction of the recording medium and is arranged so that the shutter mechanism and the plate-shaped member can be moved in a direction orthogonal to the recording medium.

12. An ink jet recording apparatus according to claim 1; further comprising a light shielding plate disposed between the ink jet head and the active ray irradiation device for shielding an active ray irradiated from the active ray irradiation device from the ink discharge surface of the nozzle portion of the ink jet head.

13. An ink jet recording apparatus according to claim 12; further comprising a light shielding plate position adjusting mechanism for maintaining constant a gap between the plate and the light shielding plate even when positions of the ink jet head and the active ray irradiation device are adjusted with respect to the recording surface of the recording medium.

14. An ink jet recording apparatus according to claim 12; wherein the plate is parallel to the recording surface of the recording medium.

15. An ink jet recording apparatus according to claim 1; further comprising friction reducing means for reducing friction due to contact between the plate and the recording medium.

16. An ink jet recording apparatus according to claim 1; further comprising an ink removing layer provided on a part or an entire surface of the plate which is brought into contact with the recording medium for facilitating removal of active ray curing type ink that adheres to the part or entire surface of the plate.

17. An ink jet recording apparatus according to claim 1; wherein the plate is parallel to the recording surface of the recording medium.

18. An ink jet recording apparatus according to claim 6; further comprising an anti-reflection material disposed on a surface on a side of the ink jet head and on a side of the active ray irradiation device of the plate for preventing reflection of an active ray irradiated from the active ray irradiation device.

19. An ink jet recording apparatus according to claim 6; further comprising an anti-reflection material disposed on a surface on a side of the ink jet head and on a side of the active ray irradiation device of the plate for preventing reflection of an active ray irradiated from the active ray irradiation device.

* * * * *